United States Patent [19]

Manizza et al.

[11] 4,260,098

[45] Apr. 7, 1981

[54] TRAY CONTAINER WITH REINFORCED SIDEWALLS

[75] Inventors: Guelfo A. Manizza, Blauvelt, N.Y.; Douglas L. Neale, Libertyville, Ill.

[73] Assignee: Federal Paper Board Company, Inc., Montvale, N.J.

[21] Appl. No.: 36,326

[22] Filed: May 7, 1979

[51] Int. Cl.[3] ..... B65D 5/36

[52] U.S. Cl. ..... 229/31 R; 229/31 FS

[58] Field of Search ..... 229/31 R, 31 FS

[56] References Cited

U.S. PATENT DOCUMENTS

| | | | |
|---|---|---|---|
| 1,003,510 | 9/1911 | Rebber | 229/31 FS |
| 1,271,033 | 7/1918 | Hall | 229/31 R |
| 2,485,704 | 10/1949 | Cranshaw | 229/31 R X |
| 3,423,008 | 1/1969 | Mykleby | 229/31 R |
| 3,559,869 | 2/1971 | Reynolds | 229/31 FS |
| 3,904,104 | 9/1975 | Kane | 229/31 R |
| 3,927,823 | 12/1975 | Persson | 229/31 R |
| 4,019,675 | 4/1977 | Andersson | 229/31 R |
| 4,114,797 | 9/1978 | Manizza | 229/31 R |

*Primary Examiner*—Davis T. Moorhead

*Attorney, Agent, or Firm*—Guy A. Greenawalt

[57] ABSTRACT

A tray-type container and a method of forming the same container is disclosed which is formed from a single blank of paperboard having a coating of a heat sealable film material so as to provide when fully set up, a rectangular bottom wall forming panel with hingedly connected upstanding sidewall and end wall forming panels which are integrally connected at the corners by pairs of triangular web members folded upon each other and against the outside faces of the end walls where they are secured by narrow top edge reinforcing and stiffening strips folded downwardly of the top edge into overlying relation with the top portions of the folded web members and the end wall, which reinforcing strips are heat sealed to corner connecting tab members folded with the corner web members into position beneath the strips.

6 Claims, 7 Drawing Figures

TRAY CONTAINER WITH REINFORCED SIDEWALLS

BACKGROUND OF THE INVENTION

This invention relates to containers and is more particularly concerned with improvements in product containers which are in the form of a tray and which are adapted to be fabricated from paperboard or similar foldable sheet material of a character which will enable the container to be used for processing and marketing of products which may be in a flowable state when initially placed in the tray, such as, bakery products.

Tray containers have been developed heretofore which are particularly adapted for use in the bakery industry where the product may be processed in an oven and subsequently marketed without removing it from the container in which it has been processed. Products such as cakes, pastry, and the like are generally in a flowable state initially, that is, in a liquid or semi-liquid condition, and it is a requirement that the container be leakproof when filled to a predetermined level with the product and capable of withstanding oven temperatures during the baking process without damage from the heat so that the baked product may be marketed without removal from the container. For such products, containers have been developed which are adapted to be formed from thin metal foil or relatively stiff metallic sheet material which can be pressed or shaped to the desired form and become part of the final package in which the product is marketed. Such containers are generally expensive and lacking in esthetic appeal since they do not readily accept the inks commonly employed in decorative printing. Efforts have been made, with some degree of success, to provide non-metallic trays which are suitable for this purpose. One such tray structure is disclosed in U.S. Pat. No. 4,114,797 granted Sept. 19, 1978. However, there appears to be a need for trays of this type which have greater rigidity or stiffness particularly at the top margins of the sidewall panels and which are more versatile in use particularly in the bakery product industry.

It is a general object therefore of the present invention to provide an improved open top tray structure of the type described which is more versatile in use, more easily handled by the user and more economical so as to compete with trays formed of metal foil, and the like, which have been produced heretofore.

It is a more specific object of the invention to provide an improved tray structure and a method of forming the same in which the tray may be fabricated from a paperboard blank or similar foldable sheet material and may be supplied to the user as a cut and scored blank, or partially folded blank, so that it can be set up with side and end wall panels upstanding from a rectangular bottom wall panel and connected at the corners by pairs of integral web members which are folded upon each other and against the outside face of an end wall with tab members for reinforcing the corner connections which tab members extend inwardly of the opposite ends of the end walls and are heat sealed to end wall reinforcing strip members at each end, which strip members are integral with and folded downwardly of the top edge of the end wall so as to overlie the top margin of the end wall and the associated folded corner web members.

It is a further object of the invention to provide a tray structure of the type described and a method of fabricating the same so as to provide integrally hinged top edge reinforcing strip members on the sidewall and end wall panels which strip members are disposed in overlying relation on the top outside margins of the wall panels and adhesively connected to tab members forming end extensions on the sidewall reinforcing strip members so as to reinforce the top edges of the tray and the connecting corner structures.

The invention as herein disclosed and claimed comprises a tray structure and a method of forming the same from a cut and scored blank of paperboard or similar foldable sheet material which comprises a bottom wall forming panel and oppositely disposed pairs of peripherial sidewall forming panels which are integrally hinged into upstanding relation with the bottom wall forming panel and connected at the intersecting corners by pairs of integrally hinged triangular web members folded into overlying relation on the outside face of the one sidewall panel and secured by corner reinforcing tab members which are disposed beneath an edge reinforcing strip which is integrally hinged to the top edge of the associated sidewall forming panel and turned down into overlying relation on the top outside margin thereof.

DESCRIPTION OF THE PREFERRED EMBODIMENTS OF THE INVENTION

Figure 4:
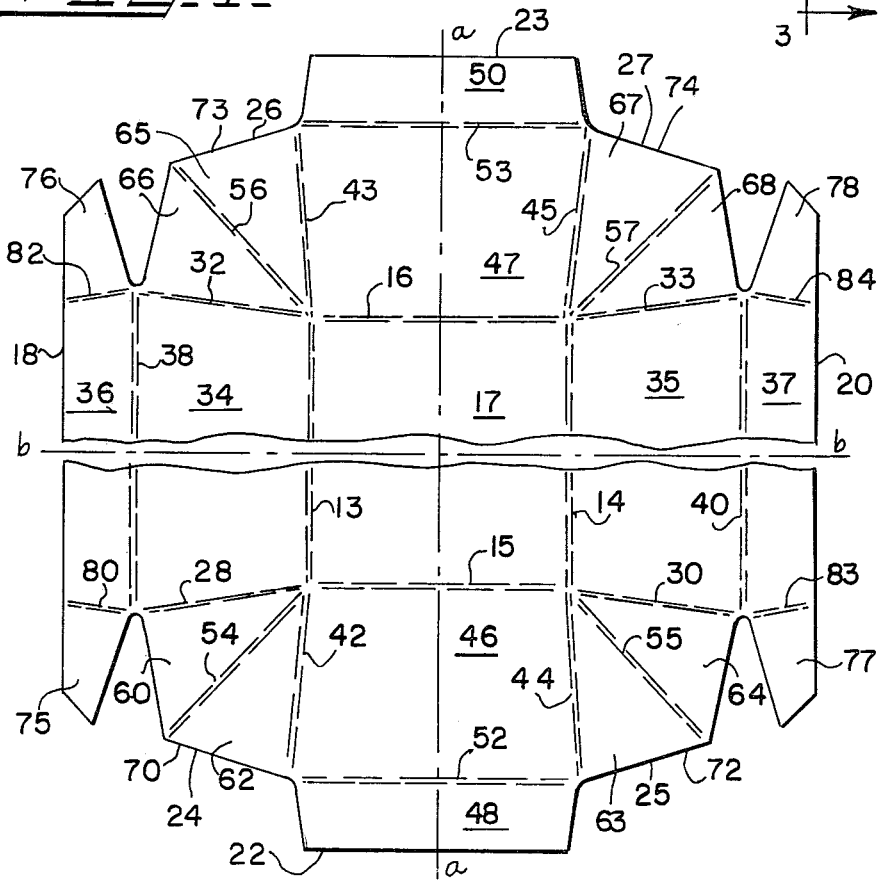
FIG. 4 is a plan view with portions broken away, showing the outside face of a paperboard blank which is cut and scored preparatory to the forming of the tray shown in FIG. 1.

Referring to the drawings there is illustrated a tray type container or carton 10 which is particularly adapted for use in the preparation and marketing of bakery products, or the like, which tray structure is fabricated from a single sheet of flexible paperboard cut and scored as illustrated in FIG. 4. It will be understood that the container shown in the drawings is described and illustrated for the purpose of setting forth the presently preferred form of the invention and that the principles of the invention may be otherwise applied.

Figure 1:
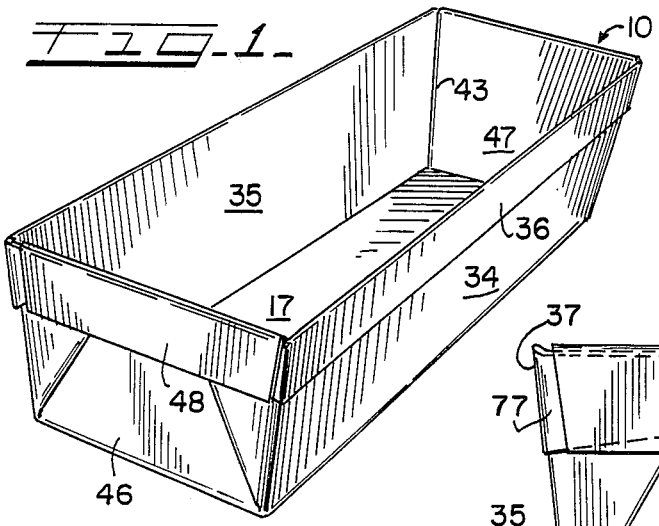
FIG. 1 is a perspective view of a tray type container which embodies the principal features of the invention.
Figure 2:
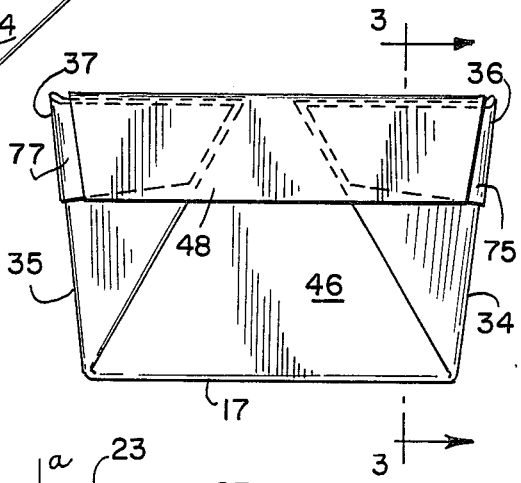
FIG. 2 is an elevational view of the end of the tray container shown in FIG. 1.
Figure 3:
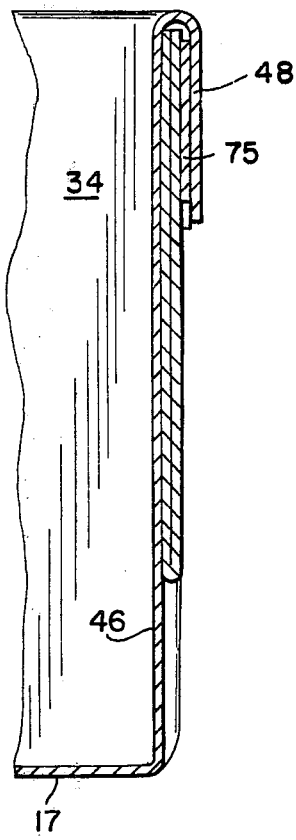
FIG. 3 is a cross sectional view taken on line 3—3 of FIG. 2 to an enlarged scale.

The tray 10, as illustrated in FIGS. 1, 2, and 3, is fabricated from the cut and scored blank 12 which is shown in FIG. 4 with the face uppermost which will be the outside face in the setup tray. In the form illustrated the blank 12 is prepared from paperboard, of relatively light weight or gauge, which is coated or laminated with a suitable material to render it more resistant to damage when subject to high temperatures, such as baking oven temperatures. The paperboard stock is of a gauge which will provide the degree of stiffness desired so that, the fully formed tray or carton will retain its normal shape when filled with the liquid product which is to be processed. The illustrated material is provided with a coating of material which will increase its resistance to absorption of heat to the degree desired for withstanding baking oven temperatures and which will also permit heat sealing of the coated surface to the paperboard surface. A suitable treatment of paperboard stock to form the blank 12 is set forth in U.S. Pat. No. 3,904,104 granted Sept. 9, 1976 to William Paul Kane.

Figure 5:
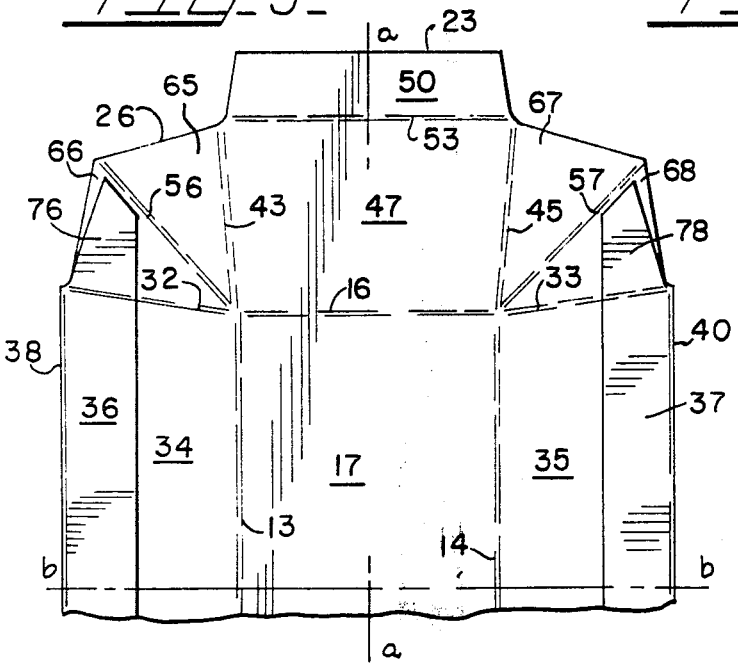
FIG. 5 is a partial plan view showing an initial folding step in the forming of the tray.

The blank 12, in the form of a generally rectangular sheet of the foldable material, is cut and scored or creased, so that it is symmetrical about longitudinal and transverse center lines a—a and b—b (FIG. 4). Parallel, longitudinally extending, transversely spaced, hinge forming score or crease lines 13, 14 and parallel transversely extending, longitudinally spaced, hinge forming score or crease lines 15, 16 define a bottom wall forming center panel 17, and form bottom edges of sidewall forming panel portions 18 and 20, and end wall forming panel portions 22 and 23. The side and end wall panels are connected at the four corners of the blank by corner connecting web portions 24, 25, 26 and 27. The transverse score lines 15 and 16 are extended at their opposite ends on lines 28, 30, 32, 33, respectively, on a slight angle or inclination in the direction of the opposite ends of the blank and define the opposite ends of the sidewall panels 34 and 35 with these panels having relatively narrow edge reinforcing panel portions 36, 37 which extend along the free outer margins thereof and which are divided therefrom by score lines 38 and 40, the latter being parallel with and spaced outwardly of the score lines 13 and 14, respectively. The longitudinal score lines 13 and 14 are extended at their opposite ends on lines 42, 43 and 44, 45 which are at a slight angle or inclination in the direction of the opposite sides of the blank and which define the ends of end wall panels 46 and 47, the latter having at their outboard margins relatively narrow edge reinforcing panel portions 48 and 50 which are divided therefrom by score lines 52 and 53 which score lines 52 and 53 are parallel with and spaced outwardly of the score lines 15 and 16 respectively. The corner connecting web panels 24, 25, 26 and 27 are each divided by a center fold forming score line 54, 55, 56 and 57 so as to form pairs of triangular web panels of equal size. The web panels 60 and 62 connect side and end wall panels 34 and 46 while panels 63 and 64 connect side and end wall panels 35 and 46, at one end of the blank. At the other end of the blank panels 65 and 66 connect side and end wall panels 34 and 47. The outside terminal edges 70, 72, 73 and 74 of these corner web panels are cut on lines which are intersected by the diagonal score lines 54, 55, 56 and 57 with the two halves of each of these edges on lines approximately normal to the score lines which define the ends of the associated end wall and sidewall panels, so that the pair of web panels at each corner may be folded into position along the outside face of the associated end wall with the top edge of each triangular web panel positioned only a small distance below the top edge of the end wall which permits the associated end wall edge reinforcing panels 48 and 50 to be folded into overlying relation therewith along the top outside margin of the associated end walls panels 46 and 47. The edge reinforcing panels 36 and 37 on the side wall panels 34 and 35 are each extended at their opposite ends to provide integral corner connecting tabs 75 and 76 on the panel 36, and tabs 77 and 78 on the panel 37. The tabs 75, 76 and 77, 78 extend beyond transverse hinge fold lines 80, 82 and 83, 84 and are cut so as to overlie the uppermost marginal portion of the adjacent triangular web panels 61, 65 and 64, 68 with the coated face exposed when the reinforcing marginal strip members 36 and 37 are folded about the lines 38 and 40 into the position shown in FIG. 5.

In forming the tray 10 form the blank 12, the blank may be supplied initially with the edge reinforcing panels 36 and 37 folded about the hinge score lines 38 and 40 onto the outside face of the sidewall panels 34 and 35 and adhesively secured to the same. The cut and scored blank may, of course, be supplied without any folding and the panels 36 and 37 folded by the user in setting up the tray. The end wall panels 46 and 50 may be folded on the hinge lines 15 and 16 simultaneously with the folding of the sidewall panels 34 and 35 about the hinge lines 13 and 14. The corner connecting web structures 24, 25, 26 and 27 will fold with the end and sidewall panels with which they are integrally connected and the two halves of each such corner structure will fold upon themselves and about the hinge lines 42, 43, 44 and 45 with the folded panels being directed into overlying relation on the outside face of the end wall panels leaving the corner connecting tabs 75, 76 and 77, 78 with the coated side or face exposed and enabling the end wall edge reinforcing panels 48 and 50 to be folded about the lines 52 and 53 into overlying relation on the top marginal portions of the outside faces of the end wall panels and the associated folded corner web structures to be heat sealed at their opposite ends to the corner reinforcing tabs 75, 76 and 77, 78 as shown in FIGS. 1, 2 and 3. The tabs 75, 76 and 77, 78 are folded in this manner around the top portions of the corners and reinforce the corners while at the same time they serve to hold the side wall and end wall reinforcing strips in position so as to rigidify the top edge portions of the walls.

Figure 6:
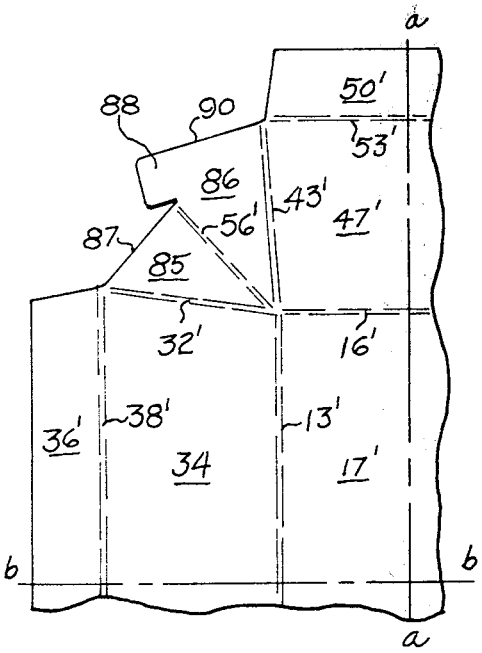
FIG. 6 is a fragmentary plan view showing a corner section of a cut and scored blank which is adapted to be employed in forming a modified tray structure.
Figure 7:
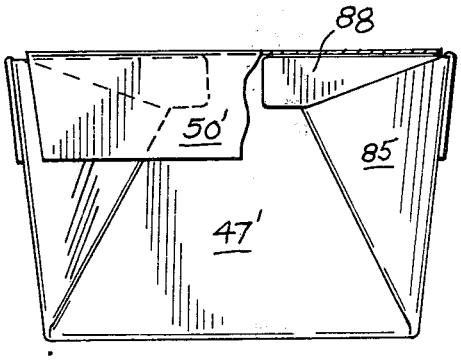
FIG. 7 is a partial end elevation, with portions broken away, showing the end structure of a tray formed with the blank of FIG. 6.

In the modification illustrated in FIGS. 6 and 7 the reinforcing and connecting tabs at the corners of the tray are derived from the materials in the corners of the blank by cutting the corner web material in a different manner. In FIG. 6 one corner only of the blank is shown and portions of the blank which correspond to elements of the blank in FIG. 4 are identified by the same numerals primed. In this form of the blank the material in the corner 26' which lies between the hinge score lines 32' and 43' is divided by the hinge score line 56' into two triangular panels 85 and 86. The outer margin of panel 85 is cut back on the line 87 while the adjoining panel 86 which is hinged on the score line 43' is extended at the margin to provide a tab formation 88 with the outermost edge 90 cut on a line which is very nearly normal to the hinge score line 43' so that when the panels are folded in the same manner as described with reference to the forming of the tray 10 the tab formation 88 will lie on the outside face of the end wall panel 47' adjacent the topmost edge with a substantial portion of the coated face thereof exposed for sealing to the uncoated face of the end wall reinforcing strip 50'. The edge strip 50' may be turned down on the hinge line 16' and secured in position by heat sealing to the tab formations which extend in from the ends of the side wall panels. This arrangement provides the degree of rigidity which is desired for most uses with some sacrifice of the depth of the leak proof portion afforded by the tray, as compared with the tray 10 of FIG. 1.

Both forms of the tray may be hand erected from the blank. They are both adapted for machine handling with relatively simple machine structure required.

While a tray of rectangular configuration is illustrated it will be understood that the tray may take other forms with oppositely disposed pairs of sidewalls of equal size, as in a square configuration, in which event the corner web structures would be folded to lie in pairs at opposite ends of a sidewall panel with a corner reinforcing tab securing opposite ends of the edge reinforcing strip of the panel against which the web members are folded.

We claim:

1. A container in the form of a film coated paperboard tray (10) having a bottom wall forming panel (17), integral wall forming panels (34, 35, 46, 47) disposed in upstanding and paired relation about the periphery of the bottom wall forming panel (17) and integral corner connecting web panels (24, 25, 26, 27) in paired relation (60, 62; 63, 64; 65, 66; 67, 68) at each corner, each pair of said corner connecting web panels being folded upon a median line (54, 55, 56, 57) and disposed in overlying relation on the end portion of the outside face of the one adjoining upstanding wall forming panel (34, 35) at the respective corner, so as to render the corner leak proof for at least a major portion of the depth of the tray, as measured from the bottom wall forming panel (17), said upstanding wall forming panels (34, 35 46, 47) each having a relatively narrow integral edge reinforcing panel portion in the form of a narrow strip (36, 37 , 48, 50) folded down from the top edge forming score line (38, 40, 52, 53) thereof and adhesively secured along the top margin of the outside face of said upstanding wall panel, each pair of triangular corner web panels having associated therewith a corner connecting tab (75, 76, 77, 78) which is positioned along the top margin of the outside face of the upstanding wall panel against which pairs of folded triangular web panels are disposed in overlying and paired relation and at opposite ends thereof, and each said corner connecting tab (75, 76, 77, 78) underlying an end portion of the integral edge reinforcing panel portion (48, 50) which is folded down from the top edge (52, 53) of said upstanding wall panel (46, 47) against which the triangular corner web panels are folded, and said edge reinforcing panel portion (48, 50) being secured in heat sealed relation at its opposite end margins to said corner connecting tab members (75, 76, 77, 78) which underlie the same.

2. A container as set out in claim 1 wherein said corner connecting tab members (75, 76, 77, 78) are integral with the edge reinforcing panel portions (36, 37) on the upstanding wall panels (34, 35) which adjoin the upstanding wall panel against which the corner tab members (75, 76, 77, 78) are positioned and said tab members being folded about the associated corners.

3. A container as set out in claim 1 wherein said corner connecting tab members (88) are each integral with a corner connecting web panel.

4. A cut and scored blank of foldable paperboard sheet material for fabricating a container in the form of a tray which blank is coated, on the face thereof which is adapted to be the inside face of the tray, with a heat resistant film forming material of a character which will resist damage to the paperboard at baking oven temperature and which is heat sealable when engaged with the uncoated paperboard, said blank being generally rectangular and being cut and scored to provide a central bottom wall forming panel (17) which is defined by pairs of spaced, transversely and longitudinally extending score lines (13, 14, 15, 16), and pairs of oppositely disposed sidewall and end wall forming panels (34, 35, 46, 47) which are spaced around the periphery of said bottom wall forming panel and which are scored on lines (38, 40, 52, 53) parallel with and spaced outboard of the score lines (34, 35, 46, 47) defining the periphery of said bottom wall forming panel (17) to provide relatively narrow edge reinforcing panel portions (36, 37, 48, 50) extending along the outboard margins of each of the sidewall (34, 35) and end wall (46, 47) forming panels and the material at the corners of the blank being further cut and scored to provide pairs of triangular corner web panels (60, 62; 63, 64; 65, 66; 67, 68) connecting the adjoining sidewall and end wall forming panels and an integral corner connecting tab (75, 76, 77, 78) at each corner which is located so that when it is folded against the uncoated outside face of said end wall panel (46, 47), said tab will lie along a top margin forming portion of said end wall forming panel (46, 47) with the coated face exposed for heat sealing engagement beneath the end of the narrow edge reinforcing panel portion (48, 50) on said end wall panel (46, 47).

5. A cut and scored blank as set forth in claim 4 wherein said corner connecting tab at each corner of the blank is cut from the material at the end of a sidewall edge reinforcing panel portion (36, 37) and divided therefrom by a hinge-score line (80, 82, 83, 84) which extends from the outboard end of a hinge-score line (28, 32, 30, 33) defining the end of the associated sidewall panel (34, 35).

6. A cut and scored blank as set forth in claim 4 wherein said corner connecting tab (88) at each corner of the blank is cut from the outboard marginal portion of a triangular web panel (86) which adjoins the end wall forming panel (47') at the end of the blank.

* * * * *

UNITED STATES PATENT AND TRADEMARK OFFICE

CERTIFICATE OF CORRECTION

PATENT NO. : 4,260,098

DATED : April 7, 1981

INVENTOR(S) : Manizza and Neale

It is certified that error appears in the above—identified patent and that said Letters Patent is hereby corrected as shown below:

Column 2, line 62, delete "setup", and insert in place thereof -- set up --.

Column 3, line 50, after "47", insert -- and panels 67 and 68 connect side and end wall panels 35 and 47 -- .

Column 5, line 27, after "35", insert -- , --.

Signed and Sealed this

*Fourth* Day of *August 1981*

[SEAL]

*Attest:*

GERALD J. MOSSINGHOFF

*Attesting Officer*

*Commissioner of Patents and Trademarks*